US006152263A

United States Patent [19]

Van Oers et al.

[11] Patent Number: 6,152,263

[45] **Date of Patent: *Nov. 28, 2000**

[54] SCAFFOLD AS WELL AS METHOD FOR ITS ASSEMBLY

[75] Inventors: Johanna Maria Van Oers, Eindhoven, Netherlands; Demetrios Georgiou Papadopoulous, Hounslow, United Kingdom; Alphonsus Antonius Garritsen, Beek en Donk, Netherlands

[73] Assignee: SGB Holdings, Helmond, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 09/000,216

[22] PCT Filed: Jul. 23, 1996

[86] PCT No.: PCT/NL96/00298

§ 371 Date: Apr. 10, 1998

§ 102(e) Date: Apr. 10, 1998

[87] PCT Pub. No.: WO97/05347

PCT Pub. Date: Feb. 13, 1997

[30] Foreign Application Priority Data

Jul. 27, 1995 [NL] Netherlands ..... 1000891

[51] Int. Cl.[7] ..... E04G 7/30

[52] U.S. Cl. ..... 182/179.1; 182/186.8

[58] Field of Search ..... 182/179.1, 178.1, 182/120, 121, 122, 186.7, 178.5, 186.8

[56] References Cited

U.S. PATENT DOCUMENTS

| | | | |
|---|---|---|---|
| 2,318,493 | 5/1943 | Johnson . | |
| 2,430,642 | 11/1947 | Mahaffey | 182/121 |
| 2,445,453 | 7/1948 | Pennington . | |
| 2,618,515 | 11/1952 | Marchessault . | |
| 3,276,543 | 10/1966 | Kanoza | 182/122 |
| 3,724,595 | 4/1973 | Green | 182/118 |
| 3,817,641 | 6/1974 | Steele | 182/186.8 |
| 3,835,612 | 9/1974 | Beziat . | |
| 3,870,124 | 3/1975 | Howard | 182/120 |
| 4,160,493 | 7/1979 | Brice | 182/122 |
| 4,303,145 | 12/1981 | Vazquez | 182/122 |
| 4,782,914 | 11/1988 | Nail | 182/113 |
| 5,507,363 | 4/1996 | Tredup | 182/122 |

*Primary Examiner*—Alvin Chin-Shue
*Attorney, Agent, or Firm*—Milde, Hoffberg & Macklin, LLP

[57] ABSTRACT

A scaffold comprises a construction assembly and a frame that is provided with a foot. The foot is in an embodiment provided with a stepped opening, a first part of which is limited by a wall which forms a supporting surface with which the frame rests on a construction member of the construction assembly when being assembled. The stepped opening comprises further a second part that lies deeper in which the construction member is situated when assembled. When coupling the frame to the construction assembly the frame is placed at an angle to the construction member. The frame is then tilted up into a vertical position in which the frame rests with its supporting surface on the construction member and pivots on the construction member. In an embodiment the foot is then moved horizontally where the supporting surface is freed from the construction member as a result of which the frame moves downwards with respect to the construction member and coupling is effected.

14 Claims, 11 Drawing Sheets

SCAFFOLD AS WELL AS METHOD FOR ITS ASSEMBLY

Figure 1:
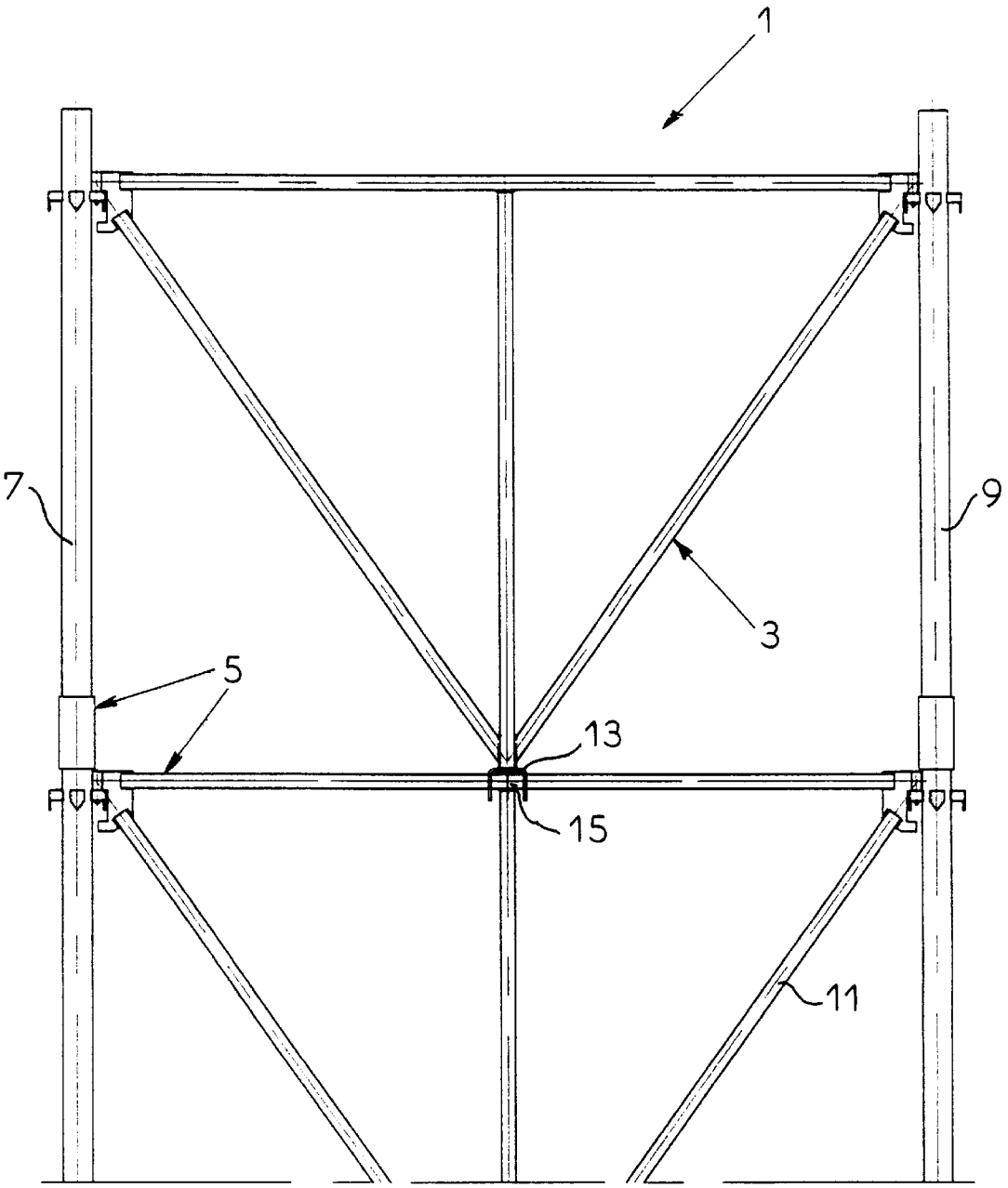

The invention relates to a scaffold consisting of a construction assembly and a frame coupled to the construction assembly, which frame is provided with at least one foot.

Such scaffolds are known generally and are chiefly used in the building industry. The construction assembly comprises for the most part a number of uprights which are coupled to each other by means of construction elements in order to provide structure and to increase the construction's stability. For the most part, the uprights are made up of various pipes coupled to each other. The coupling between the construction assembly and the frame in the known scaffold is often formed by eyes on the uprights in which there are hooks that are attached to the frame. On the lower side, the frame is often coupled to a cross-bar. For this purpose, the frame is provided with a foot which partially encircles the cross-bar.

The drawback of the known scaffolds is that when mounting the frame onto the construction assembly, the frame must be lifted up and, moreover, must be positioned with respect to the construction assembly in which the hooks and the foot have to be brought above the eyes and the cross-bar in order to then bring about coupling by lowering the frame. In addition, while positioning the frame which is already difficult enough, the weight of the frame must be lifted as well. This is a rather tiring operation. With a view to the increasingly stricter requirements with respect to working conditions in the building industry, such difficult operations are undesirable.

An aim of the invention is to provide a scaffold of the type mentioned at the beginning in which assembly can take place more simply and therefore with less effort, particularly as far as the coupling of the frame to the construction assembly is concerned. For this purpose, the scaffold according to the invention is characterized in that the foot is provided with a supporting surface with which the frame, at least while the frame is being mounted onto the construction assembly, rests on a bearing surface of the construction member. Because of this, the weight of the frame is carried by the construction assembly while it is being mounted. The worker only has to place the frame with its foot onto the construction assembly. In addition, only the foot of the frame has to be positioned with respect to the construction assembly. Only after that will coupling be brought about, for which it is necessary that the frame be positioned with respect to the construction assembly. Because of this, it is not even necessary that the frame with its foot be brought in a vertical position above the construction assembly; the frame can also be placed horizontally or at an angle after which the frame can be tilted up to the vertical position. Because of this, the frame does not have to be lifted so high.

An embodiment of the scaffold according to the invention is characterized in that the supporting surface is situated at a level lower than the bearing surface in a vertical direction when in the assembled state. By seeing that the hooks are situated above the eyes after tilting up the frame, coupling can be brought about just by lowering the frame. It is not necessary to lift the frame up in order to bring about the coupling; it only has to be brought down a little. This is only possible if the supporting surface is also moved downwards as a result of which the supporting surface no longer rests on the construction member and when assembled is situated at a level lower than the bearing surface of the construction member.

A further embodiment of the scaffold with which lowering the frame can be realized advantageously is characterized in that the foot is provided with a stepped opening, a first part of which is limited by a wall which forms a supporting surface and which stepped opening comprises a second part which lies deeper in which the construction member is situated when in the assembled state. Because of this, after having tilted the frame into the vertical position, the frame only has to be moved a little horizontally until the part of the stepped opening that lies deeper is situated above the construction member after which the frame will fall downwards by its own weight at the same time bringing about the coupling between the hooks and the eyes or otherwise.

The construction member, moreover, may be part of an upright, for example, because the construction member is formed by a projection that is attached to an upright of the construction assembly.

The construction assembly may also comprise in addition to the uprights a number of frames which are between the uprights and are coupled to the uprights. In that case the construction member may be part of an additional frame, which is part of the construction assembly, for example, because the construction member is formed by a part of a cross-bar of the additional frame. The construction member may also be formed by a cross-element, a cross-bar for example, which is coupled to the uprights. This is particularly the case before the first frame is placed.

A further embodiment of the scaffold according to the invention is characterized in that the frame, as well as the foot mentioned, comprises an additional foot and the construction assembly, as well as the construction member mentioned, comprises an additional construction member in which the feet are at each corner of the lower side of the frame. This is especially advantageous with rectangular frames and in situations where the frame is only coupled to the uprights and not to a cross-bar of an additional frame.

Still a further embodiment is characterized in that the frame and the construction assembly have coupling parts which are coupled together. These coupling parts may be formed by hooks attached to the frame and eyes attached to the construction assembly.

Instead of bringing about the coupling by lowering the frame with respect to the construction assembly, the coupling can also be brought about by first lifting the frame up a little and then lowering it. An embodiment of the scaffold according to the invention with which the latter can be carried out advantageously is characterized in that the coupling parts on the frame and/or the construction assembly are provided with surfaces that incline upwards. If the coupling parts are executed as hooks, the walls of openings or eyes on the construction assembly can be provided with surfaces that incline upwards over which the hooks slide at the end of a tilting movement. Here, the hooks are lifted over the walls of the openings or the eyes, after which they fall into the openings or the eyes. For this purpose, the frame will have to be moved with some force against the surfaces in order for lifting to take place.

In order to facilitate the positioning of the coupling parts with respect to the supporting parts, a further embodiment of the scaffold according to the invention is characterized in that there are stops on the construction assembly and/or the frame with which the coupling parts are positioned with respect to each other during assembly. The stops have been placed, moreover, in such a way that if the stops are in contact with each other at the end of a tilting movement the coupling parts will be situated in the correct position with respect to each other in order to then be coupled together.

The invention also relates to a method for the assembly of a scaffold comprising the coupling of a frame to a construction assembly. As has already been described above, with known scaffolds the frame must be tilted up and positioned vertically with respect to the construction assembly in order to be able to realize the coupling between the frame and the construction assembly. As already explained above, this is a rather difficult operation which is undesirable with a view to the increasingly stricter requirements set on work at the building site.

In order to make assembly lighter and therefore simpler, the method according to the invention is characterized in that the frame is placed with a foot forming part of the frame on a construction member of the construction assembly, horizontally or at an angle to the construction assembly, after which the frame is tilted into a vertical position in which the frame with a supporting surface of the foot rests on the construction member and pivots on the construction member. The frame therefore does not have to be brought onto the construction assembly in a vertical position as a result of which the frame does not have to be lifted so high. Because the frame is supported by the construction assembly the frame does not have to be carried during positioning of the frame with respect to the construction assembly for the purpose of coupling, as a result of which assembly work is simpler and lighter.

An embodiment of the method according to the invention is characterized in that after the frame has been tilted into the vertical position, the foot is moved horizontally in which the supporting surface is freed from the construction member as a result of which the frame moves downwards with respect to the construction member and coupling is effected. This horizontal movement can take place simply by striking or kicking the lower half of the frame.

Another embodiment of the method according to the invention is characterized in that after the frame has been tilted into the vertical position, the frame is first lifted up and then brought down in order to bring about coupling. By providing surfaces that incline upwards on the coupling parts, as already described above, lifting can be simplified and a simple construction can be used.

In order to simplify coupling of the frame to the construction assembly, a further embodiment of the method according to the invention is characterized in that at the end of the tilting movement, coupling parts on the frame and on the construction assembly are positioned with respect to each other and while the frame is moving downwards the coupling parts couple together.

In order to simplify positioning of the frame with respect to the construction assembly, a further embodiment of the invention is characterized in that positioning takes place because the frame strikes a stop on the construction assembly at the end of the tilting movement.

Figure 2:
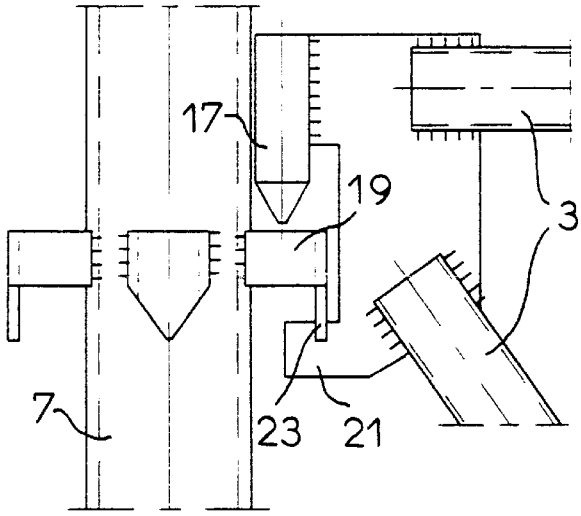
Figure 3:
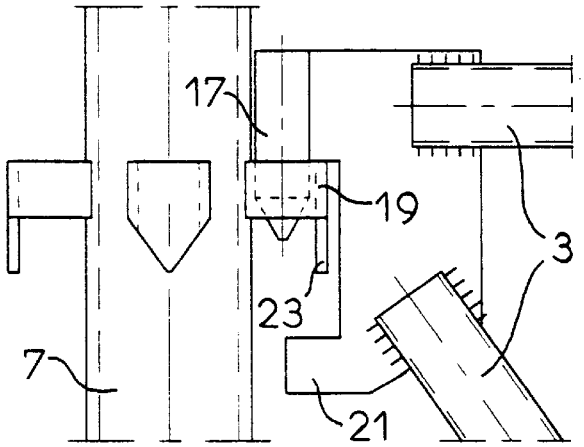
Figure 4:
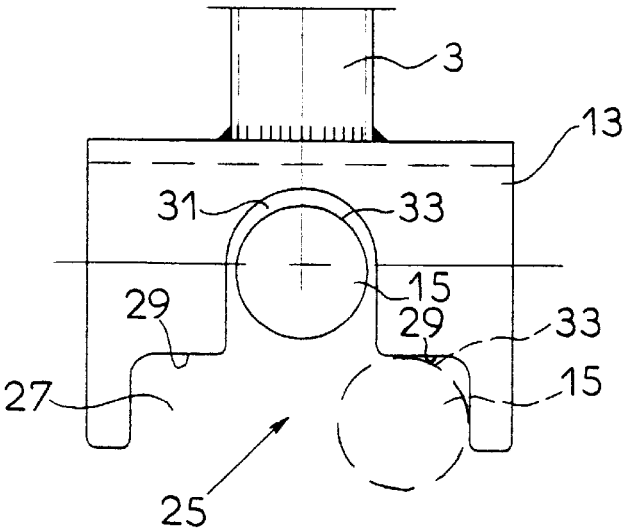
Figure 5:
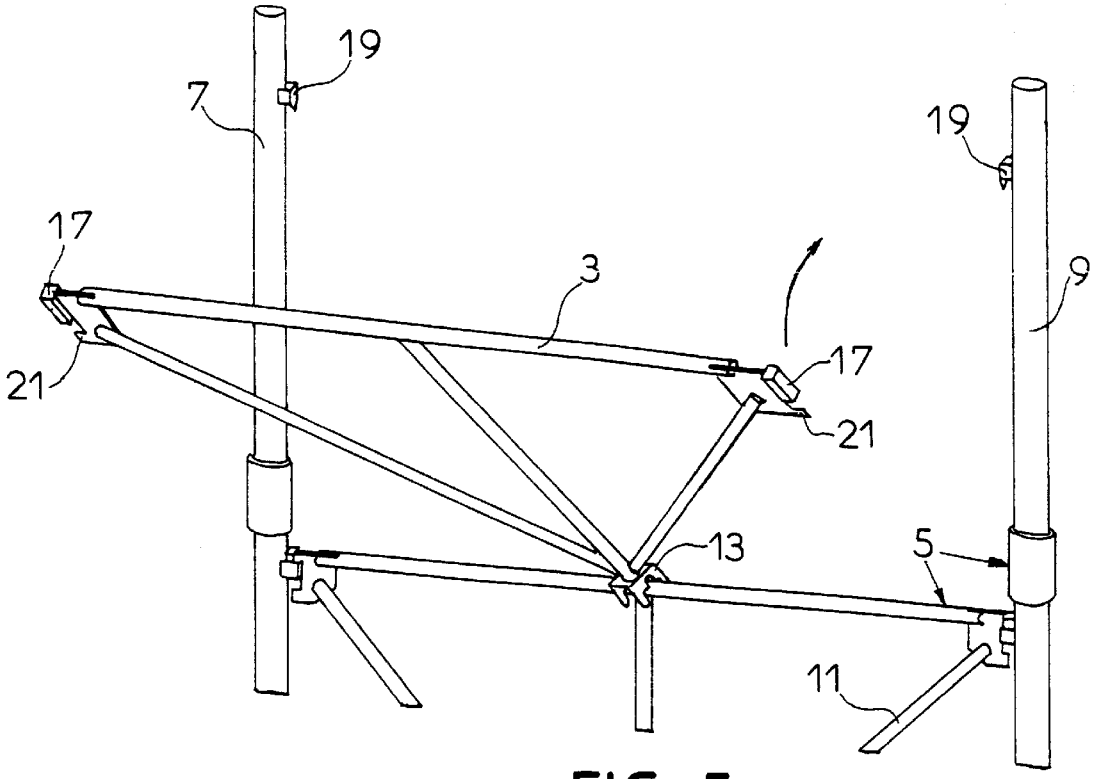
Figure 6:
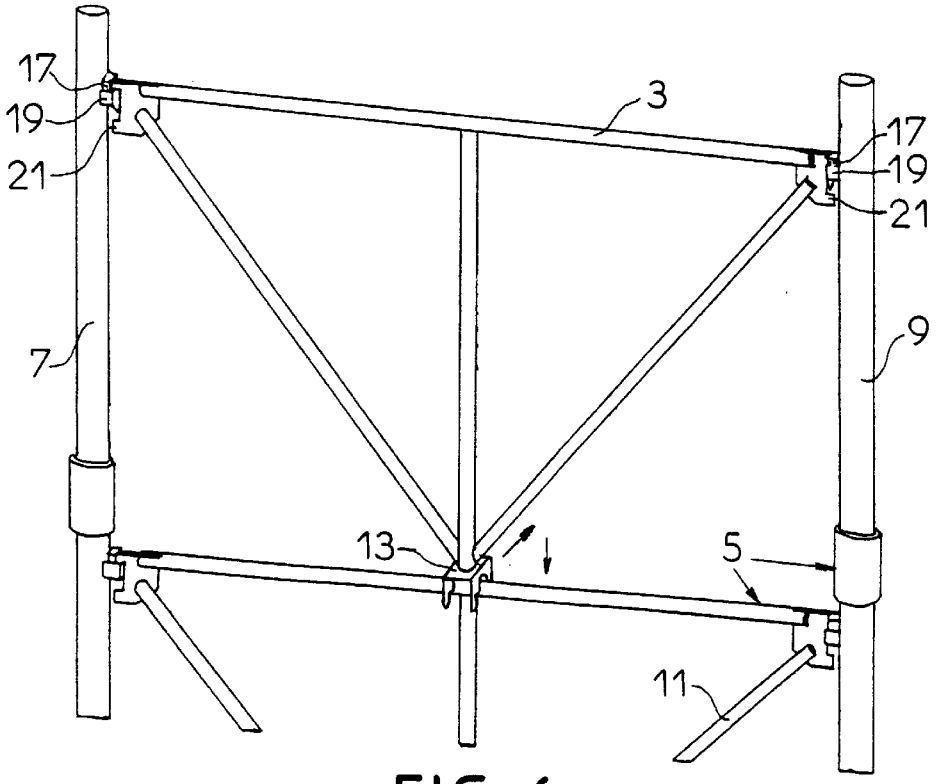
Figure 7:
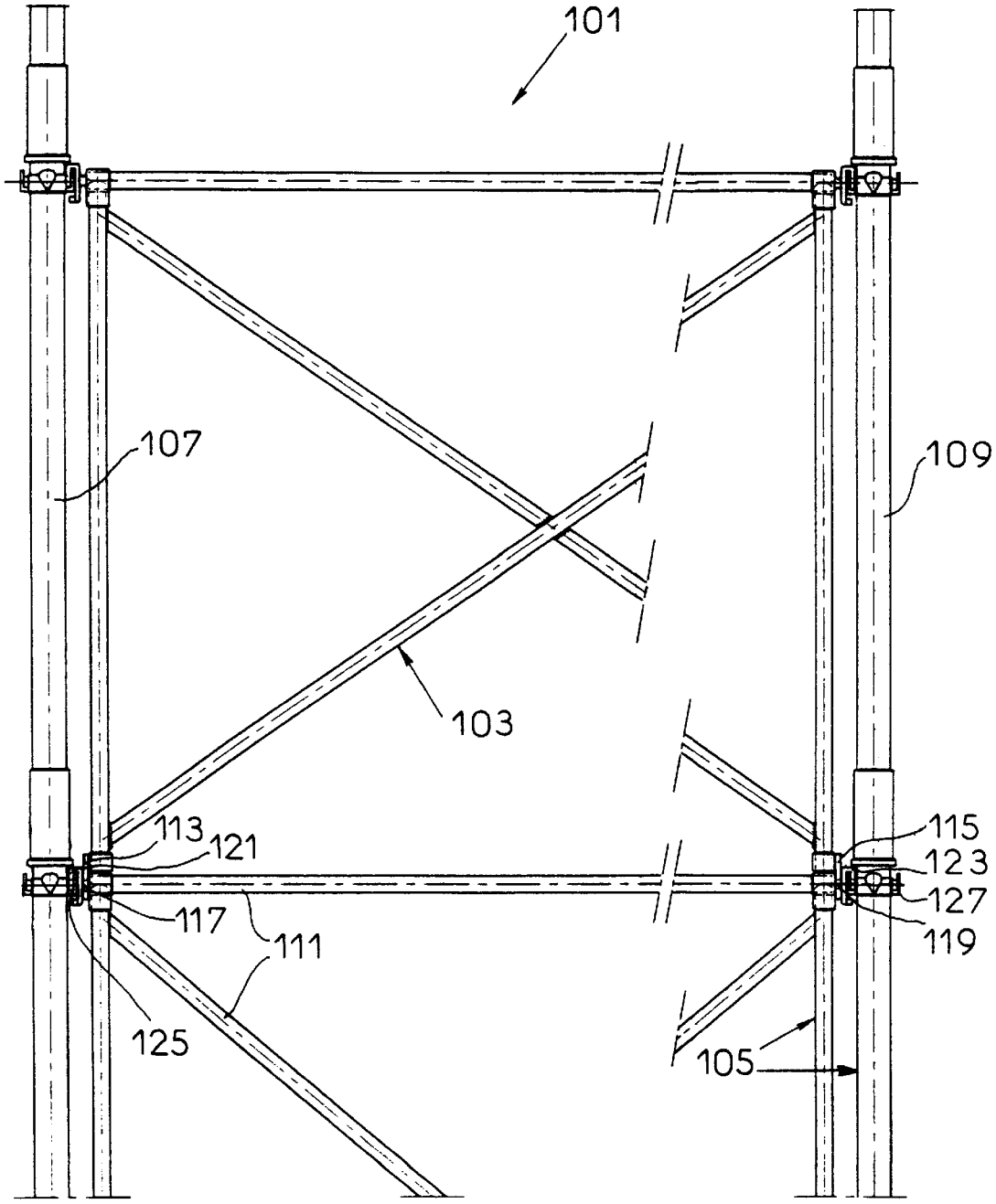
Figure 8:
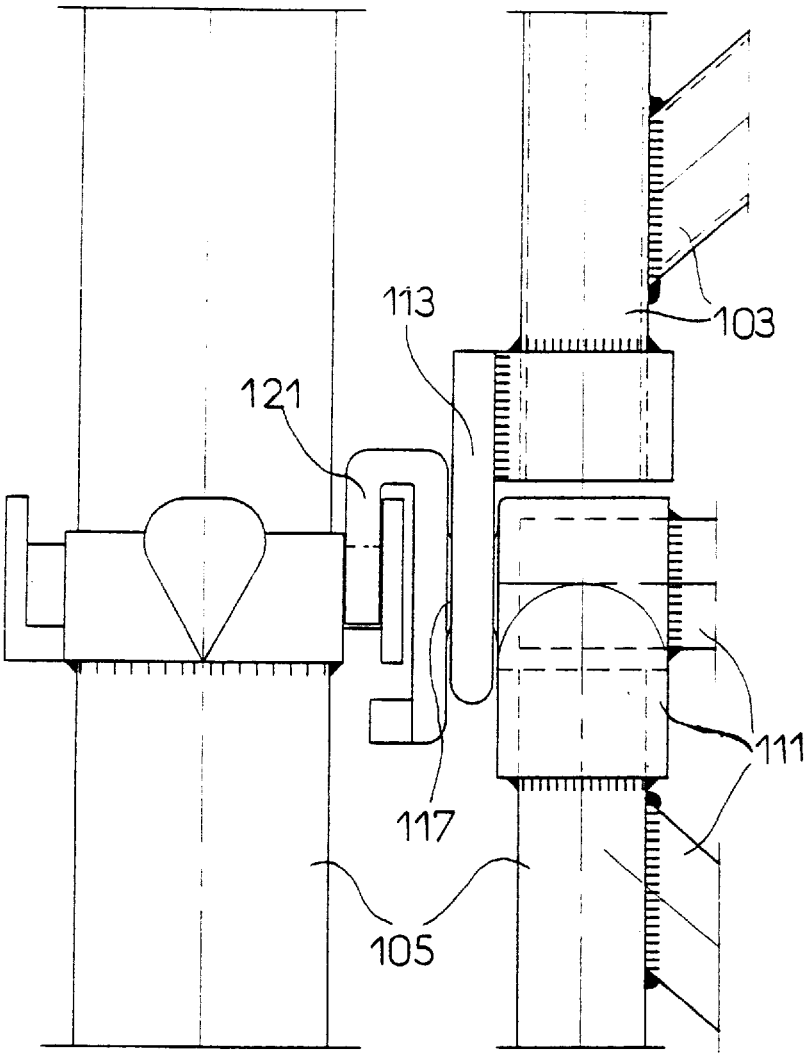
Figure 9:
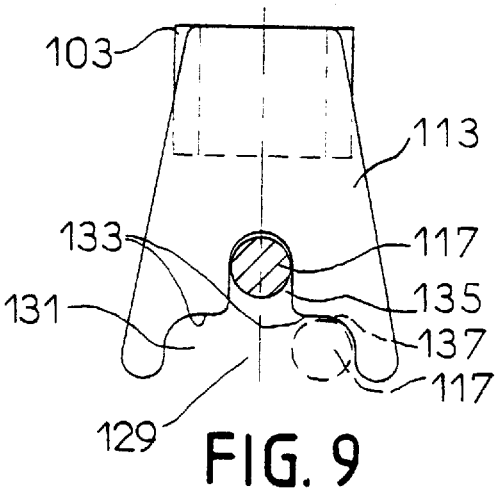
Figure 10:
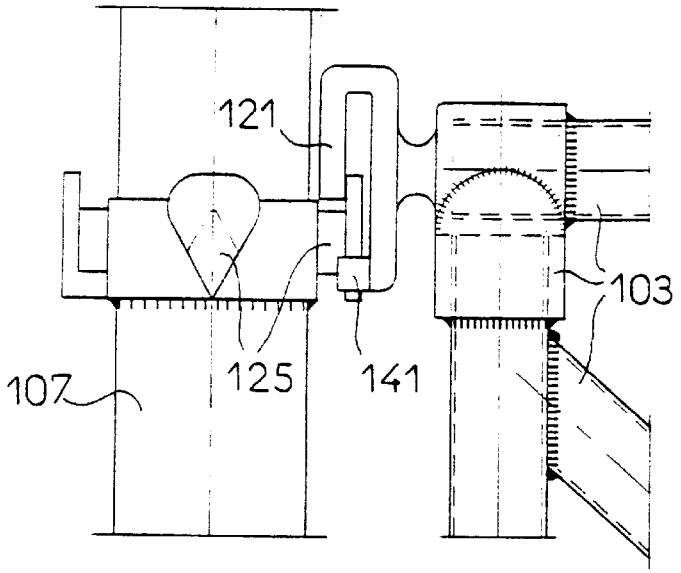
Figure 11:
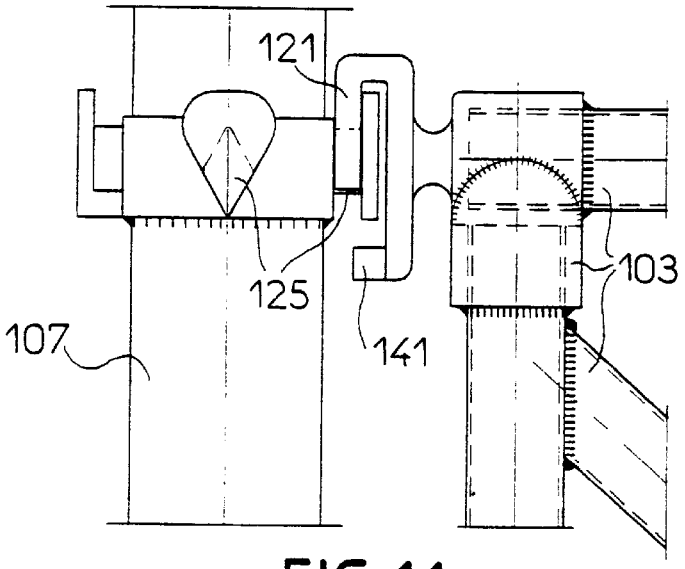
Figure 12:
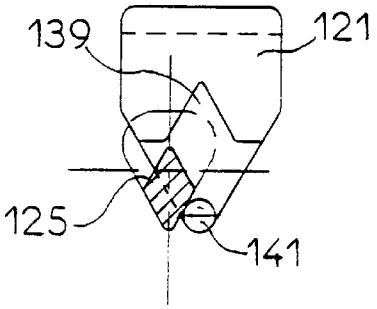
Figure 13:
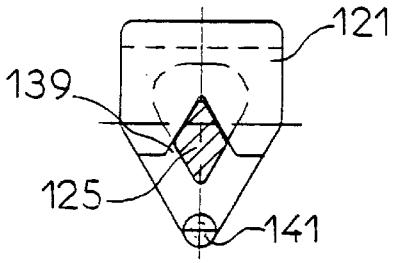
Figure 14:
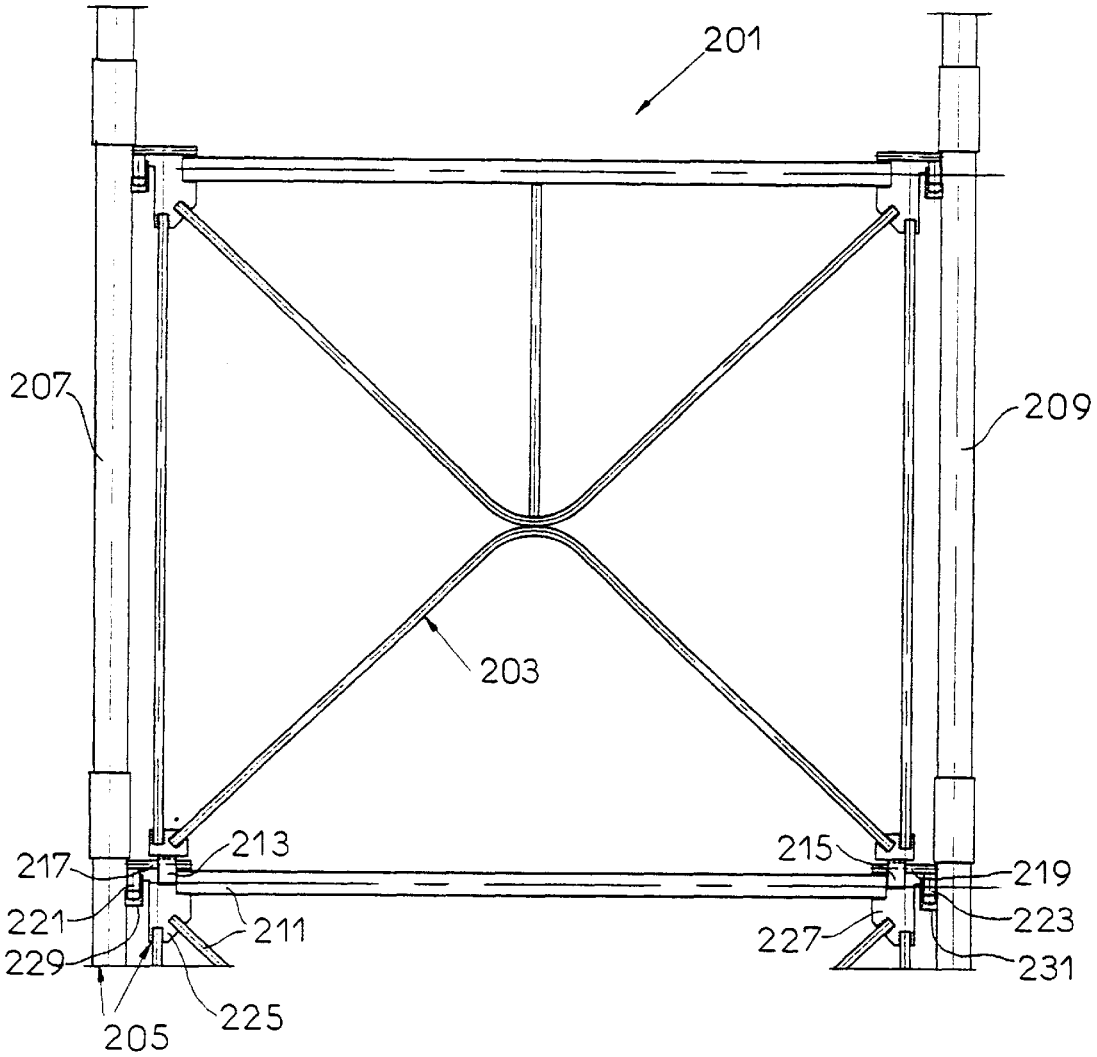
Figure 15:
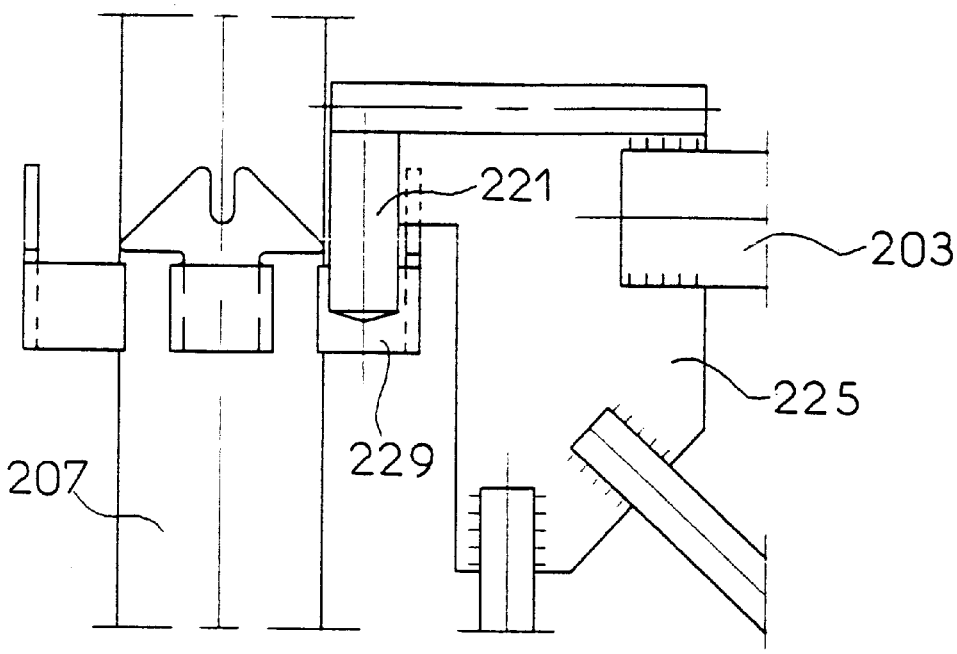
Figure 16:
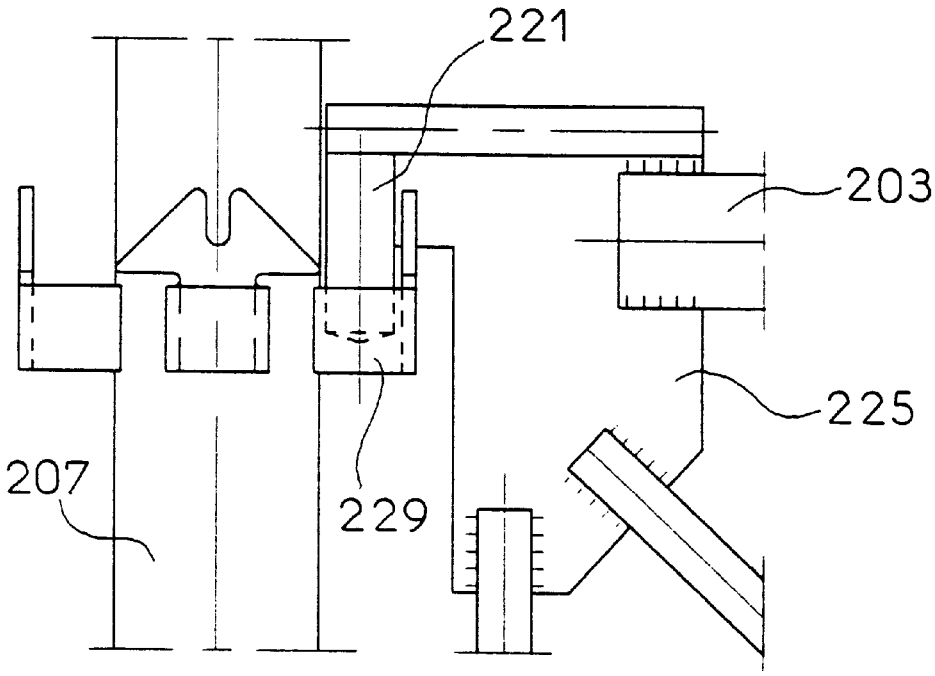
Figure 17:
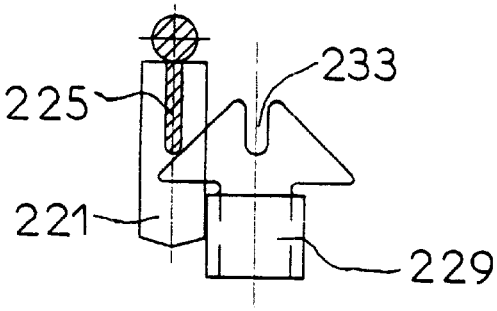
Figure 18:
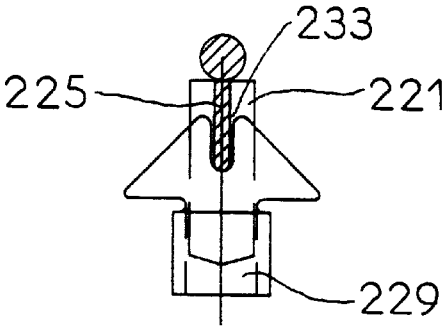
Figure 19:
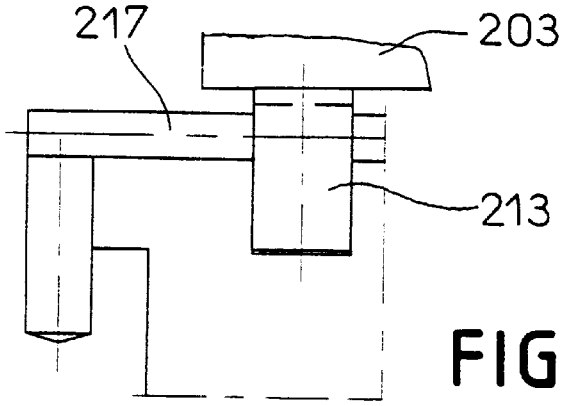
Figure 20:
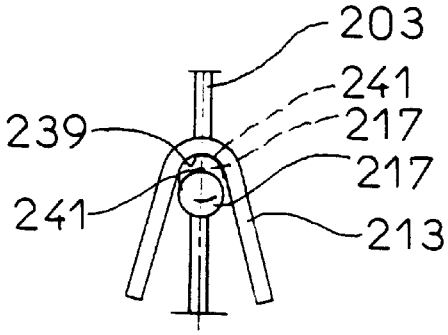
Figure 21:
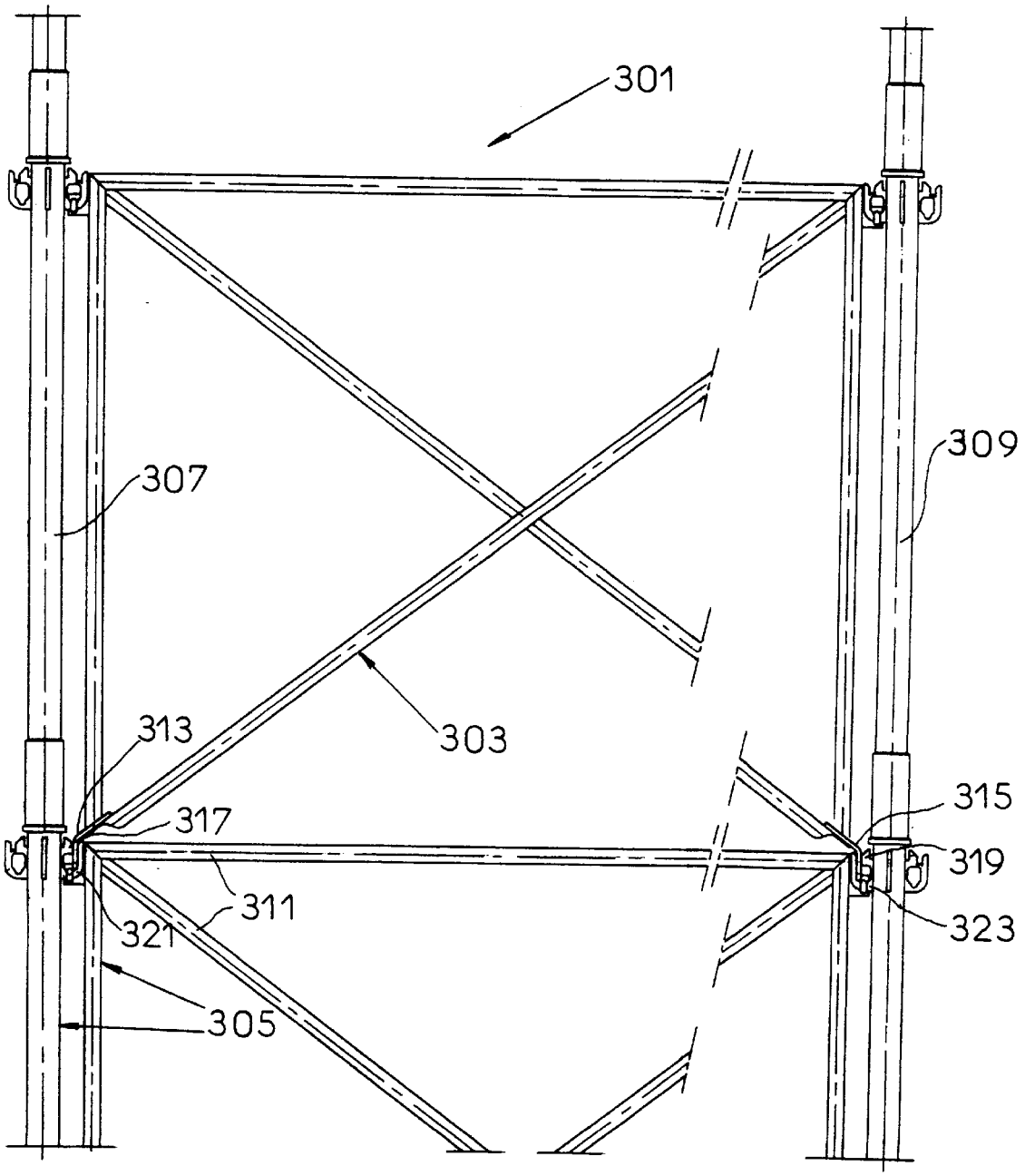
Figure 22:
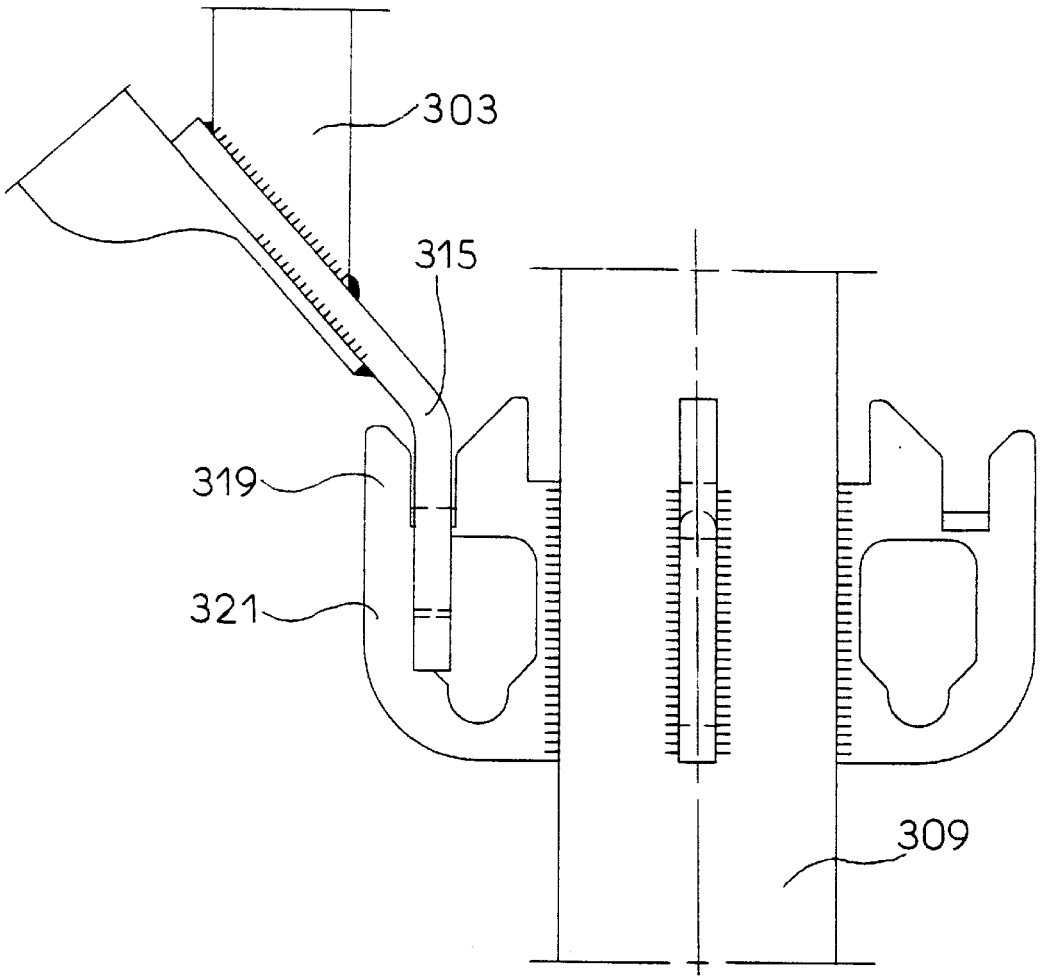
Figure 23:
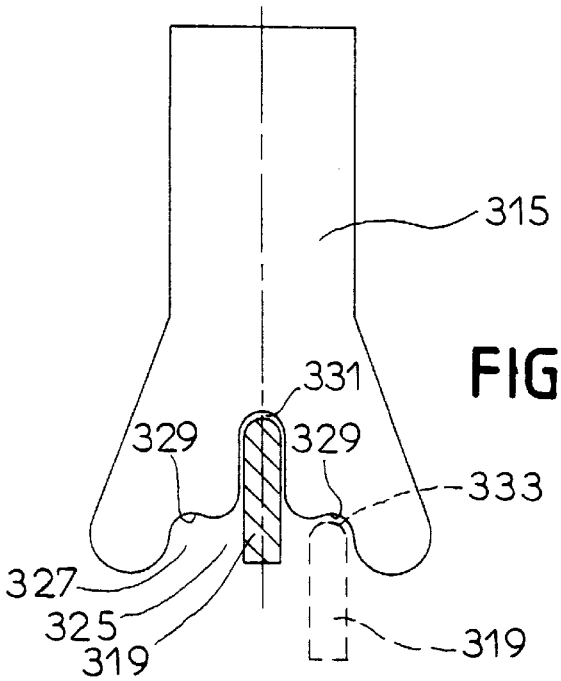

The invention will be elucidated more fully below by means of drawings in which examples of the embodiments of the scaffold according to the invention are shown. Shown are:

FIG. 1: a portion of the first embodiment of a scaffold according to the invention;

FIG. 2: a detail of the coupling parts of the scaffold in a position before coupling takes place;

FIG. 3: the coupling parts in a coupled state;

FIG. 4: a side view of a foot of a frame of the scaffold shown in FIG. 1;

FIG. 5: a first phase in mounting the frame onto a construction assembly of the scaffold shown in FIG. 1;

FIG. 6: the last phase in mounting the frame onto the construction assembly;

FIG. 7: a portion of a second embodiment of a scaffold according to the invention;

FIG. 8: a detail of a foot of a frame on a construction member of the scaffold shown in FIG. 7;

FIG. 9: a side view of the foot;

FIG. 10: a detail of coupling parts of the scaffold shown in FIG. 7 in a position before coupling takes place;

FIG. 11: the coupling parts in a coupled state;

FIG. 12: a side view of the coupling parts in the position shown in FIG. 10;

FIG. 13: a side view of the coupling parts in the position shown in FIG. 11;

FIG. 14: a portion of a third embodiment of a scaffold according to the invention;

FIG. 15: a detail of the coupling parts of the scaffold in a position just before coupling takes place;

FIG. 16: a side view of the coupling parts in the position shown in FIG. 15;

FIG. 17: a detail of the coupling parts of the scaffold in a coupled state;

FIG. 18: a side view of the coupling parts in the state shown in FIG. 17;

FIG. 19: a detail of a foot of a frame on a construction member of the scaffold shown in FIG. 14;

FIG. 20: a side view of the foot;

FIG. 21: a portion of a fourth embodiment of a scaffold according to the invention;

FIG. 22: a detail of a foot of a frame on a construction member of the scaffold shown in FIG. 21; and FIG. 23: a side view of the foot FIG. 1 shows a portion of a first embodiment of a scaffold according to the invention. The portion of the scaffold 1 can be thought of as being built up of a frame 3 and a construction assembly 5. The construction assembly, moreover, is made up of two uprights 7, 9, each of which is built up from two pipes coupled to each other, and an additional frame 11 that is situated between the two uprights and is coupled to the uprights in order to introduce structure to the construction assembly. The frame 3 is formed from a number of pipes welded to each other. The frame 3 has a foot 13 that co-operates with a construction member 15 that is formed by a part of a cross-bar of the additional frame 11 of the construction assembly 5. There are two coupling parts on the frame which cooperate with coupling parts on the uprights.

In FIGS. 2 and 3, two phases in the realization of the coupling between the frame and the construction assembly are shown in detail. FIG. 2 shows the situation in which the frame is positioned with respect to the upright just before coupling is brought about FIG. 3 shows the situation in which the coupling parts are coupled together. The coupling parts 17 on the frame 3 have been executed as hooks and co-operate with the coupling parts 19 on the uprights 7 which are formed by eyes. Furthermore, there are stops 21 on the frame 3 which during assembly co-operate with stops 23 on the coupling parts 19 (see FIG. 2). In this situation the coupling parts 17 executed as hooks are situated above the coupling parts 19 executed as eyes. By moving the frame 3 in this situation downwards, the coupling parts 17 and 19 are coupled together (see FIG. 3).

FIG. 4 shows a side view of the foot 13 of the frame 3 and of the construction member 15. In this figure, the frame and the construction member are shown in two different positions with respect to each other, that is, the position of the construction member with respect to the foot before coupling is brought about is shown by a broken line (corresponding to FIG. 2) and the position of the construction member with respect to the foot after coupling has been brought about is shown by a solid line. One should bear in mind here that the construction member occupies a fixed position and the foot occupies two different positions with respect to the construction member. This is contrary to that shown in FIG. 4. In the figure, namely two different positions of the construction member are shown; this has been done solely for the benefit of clarity. The foot 13 has two vertical plates, in each of which is a stepped opening 25. This opening comprises a first part 27 limited by a wall which forms a supporting surface 29 with which the frame 3 on a construction member 15 of the construction assembly 5 rests during assembly. Furthermore, the stepped opening 25 comprises a second part 31 that lies deeper in which the construction member 15 is situated when in the assembled state. The upper side of the construction member 15 forms a bearing surface 33 on which the frame 3 rests with its supporting surface 29 during assembly (see the position of the construction member shown by the broken line in FIG. 4). When assembled, the construction member 15 is situated in the part 31 of the stepped opening 25 which lies deeper, and it is situated at a distance from foot 13 as a result of which the frame 3 in this situation is not carried by the construction member. In this situation, the bearing surface 33 is situated at a level higher than the supporting surface 29 (see the position of the construction member indicated by the solid line in FIG. 4).

Mounting the frame 3 onto the construction assembly 5 will be elucidated by means of FIGS. 5 and 6. FIG. 5 shows the situation in which the frame 3 has been placed at an angle to the construction assembly 5 on the cross-bar of the additional frame 11 and is tilted into the vertical position. In this situation, the frame 3 with its supporting surface 33 of the stepped opening 25 (see FIG. 4, broken line) rests on the cross-bar. In FIG. 6, the frame 3 has just occupied the vertical position where the stops 21 on the frame are in contact with the stops 23 on the coupling parts 19 of the uprights 7 and 9 (see FIG. 2 also). Because of this the coupling parts 17 and 19 are positioned with respect to each other. By moving the foot 13 towards the back in a horizontal direction, the part 31 of the stepped opening 25 that lies deeper will come above the cross-bar as a result of which the frame will drop downwards under its own weight (see FIG. 4, solid line) and the coupling parts 17 executed as hooks will fall into the coupling parts 19 executed as eyes.

FIG. 7 shows a portion of a second embodiment of a scaffold according to the invention. Here as well, the portion of the scaffold 101 can be thought of as being built up of a frame 103 and a construction assembly 105 consisting of two uprights 107 and 109 and an additional frame 111. The fame has a foot 113, 115 at each corner on the lower side. These feet co-operate with construction members 117 and 119 which are formed by short connecting pins attached to the additional frame 111. Coupling parts 121 and 123 are attached to these connecting pins, which co-operate with the coupling parts 125 and 127 attached to the uprights 107 and 109.

In FIG. 8, the cooperation between the foot 113 and the construction member 117 is shown. The construction member 117 is formed by a connecting pin between the coupling part 121 and the additional frame 111. FIG. 9 shows a side view of the foot 113 with two positions of the construction member 117 analogous to FIG. 4. The position of the construction member before the coupling between the coupling parts is brought about is shown by a broken line and the position of the construction member after coupling has been brought about is shown by a solid line. There is a stepped opening 129 in the foot 113. This opening comprises a first part 131 that is limited by a wall which forms a supporting surface 133 with which the frame rests on the construction member 117 of the construction assembly 105 when being assembled. Furthermore, the stepped opening 129 comprises a second part 135 that lies deeper in which the construction member 117 is situated when assembled. The upper side of the construction member 117 forms a bearing surface 137 on which the frame 103 with its supporting surface 133 rests during assembly (see position of construction member indicated by broken line in FIG. 9). When assembled the construction member 117 is situated in the part 135 of the stepped opening 129 that lies deeper, and it is situated at a distance from the foot as a result of which the frame 103 is not carried by the construction member in this situation. The bearing surface 137 is situated at a level higher than the supporting surface 133 (see the position of the construction member indicated by a solid line in FIG. 9).

In FIGS. 10 and 12, 11 and 13 respectively two phases in the realization of the coupling between the frame and the construction assembly of the embodiment shown in FIG. 7 are shown in detail. FIGS. 10 and 12 show the situation in which the frame is positioned with respect to the upright just before coupling is brought about FIGS. 11 and 13 show the situation in which the coupling parts have been coupled together. The coupling parts 121 on the frame 103 have been executed as hooks and provided with a V-shaped opening 139 and a stop 141. These coupling parts co-operate with the coupling parts 125 on the uprights 107 which are formed by pins having a diamond-shaped cross section which also act as stops. In the situation just before the coupling is effected (see FIGS. 10 and 12), the stop 141 is in contact with the lower half of the diamond-shaped pin. The top of the upper half of the diamond-shaped pin is situated here just under the V-shaped opening 139. After the frame 103 has dropped downwards, the diamond-shaped pin is situated completely in the V-shaped opening 139 (see FIGS. 11 and 13) and the coupling parts are coupled together.

FIG. 14 shows a portion of a third of a scaffold embodiment according to the invention In this situation as well, the portion of the scaffold 201 can be thought of as being built up of a frame 203 and a construction assembly 205, consisting of two uprights 207 and 209 and an additional frame 211. At each corner on the lower side, the frame has a foot 213, 215 which co-operates with a construction member 217, 219 which is part of a coupling part 221, 223 of the additional frame 211. The coupling parts 221 and 223 are situated on the plates 225 and 227 and are in the openings of the coupling parts 229 and 231 attached to the uprights 207 and 209.

In FIGS. 15 and 17, 16 and 18 respectively two phases in the realization of the coupling between the frame and the construction assembly of the embodiment shown in FIG. 14 are shown in detail. FIGS. 15 and 17 show the situation in which the frame is positioned with respect to the upright just before coupling is brought about. FIGS. 16 and 18 show the situation in which the coupling parts have been coupled together. The plate 225 on the coupling part 221 and the frame 203 co-operates with an edge that inclines upwards of the coupling part 229 attached to the upright 207 (see FIGS. 15 and 17). During coupling, this plate slides upwards over this edge until the plate falls into an opening 233 in the coupling part 229 (see FIGS. 16 and 18). In this situation, the coupling part 221 and with it the frame 203 as well are lifted up a little in order for it then to be able to drop into the opening. During coupling, the coupling part 221 is inserted into an eye of the coupling part 229 in order to guarantee a firm coupling.

In FIGS. 19 and 20, the foot 213 and the construction member 217 are shown in detail. The foot 213 is formed by a V-shaped curved strip which partially encircles the construction member 217. In the situation just before coupling takes place (see FIGS. 15 and 17), the frame 203 with a supporting surface 239 of the foot 213 rests on a bearing surface 241 of the construction member 217 (position of the construction member 217 shown by a broken line). After the coupling has been brought about (see FIGS. 16 and 18) the supporting surface 239 is situated at a distance from the bearing surface 241 and the frame 203 is not carried by the construction member 217 (the position of the construction member 217 indicated by a solid line).

FIG. 21 shows a portion of a fourth embodiment of the scaffold according to the invention. In this embodiment as well, the portion of the scaffold 301 can be thought of as being built up of a frame 303 and a construction assembly 305, consisting of two uprights 307 and 309 and an additional frame 311. At each corner on the lower side, the frame has a foot 313, 315 which co-operates with a construction member 317, 319 which is formed by a U-shaped plate integrated in the form of an eye with a coupling part 321, 323 attached to the uprights. The coupling part cooperates with a coupling part attached to the frame and executed as a hook.

In FIG. 22 the foot 315 and the construction member 319 are shown in detail. The construction member 319 is integrated with the coupling part 323 that is attached to the upright 309. The coupling part 323 is formed by an eye in which a hook-shaped coupling part attached to a frame can catch.

FIG. 23 shows a side view of the foot 315 with two positions of the construction member 319, namely, the position of the construction member before the coupling between the coupling parts is brought about shown by a broken line and the position of the construction member after coupling has been brought about shown by a solid line. There is a stepped opening 325 in the foot 315. This opening comprises a first part 327 that is limited by a wall which forms a supporting surface 329 with which the frame rests on the construction member 319 of the construction assembly when being assembled. Furthermore, the stepped opening 325 comprises a second part 331 that lies deeper in which the construction member 319 is situated when assembled. The upper side of the construction member 319 forms a bearing surface 333 on which the frame 303 with its supporting surface 329 rests during assembly (see position of the construction member indicated by broken line in FIG. 22). When assembled the construction member 319 is situated in the part 331 of the stepped opening 325 that lies deeper and the bearing surface 333 is situated at a level higher than the supporting surface 329 (see the position of the construction member indicated by a solid line in FIG. 23).

Although the invention has been elucidated in the foregoing by means of drawings, it should be established that the invention in no way is limited to the embodiments shown in the drawings. The invention applies to all embodiments deviating from the embodiments shown in the drawings within the framework defined by the claims. Thus it is also possible to have the construction members as shown in FIG. 7 form part of the uprights instead of the frame. For example, this can be done by attaching the pin-shaped cons on members to the uprights and having the foot between the hook-shaped coupling parts of the frame and uprights cooperate with the construction members. The construction member can also be formed by a cross-bar instead of an additional frame. This is advantageous before the lowermost frame is placed. For this, a cross-bar is first placed between the uprights, which forms the construction member on which the lowermost frame rests during assembly.

What is claimed is:

1. A scaffold comprising a construction assembly having at least two uprights of which at least the upper parts are free standing, said scaffold further comprising a frame directly coupled to at least the free-standing upper parts of said two uprights, the improvements comprising said frame laying in a separate plane with said two uprights when in the first disassembled state, and then said frame laying in a common plane with said two uprights in a second assembled state, said frame being provided with at least one foot, said foot with a supporting surface operating in conjunction with a bearing surface on a construction member of a construction assembly of said scaffold, to act as a hinge, and allowing said supporting surface to rest on said bearing surface so that the weight of said frame is supported by said scaffold in said first disassembled state, said frame being swung up and attached to said two uprights, thus allowing said frame to be coupled to said construction assembly in said second assembled state, and further that said supporting surface and said bearing surface have such dimensions and shapes that said supporting surface can be rotated, and wherein said foot is provided with a stepped opening comprising a first part having a first step with respect to the open side of the opening, and a first depth with respect to the open side of the opening which is limited by a wall that forms the supporting surface and a second part which is at a greater depth from the open side of the opening than the depth of the first part in which the construction member is situated when assembled, wherein the first part having a width greater than the width of the second part.

2. Scaffold according to claim 1, wherein the supporting surface when in an assembled state is situated in the vertical direction at a level lower than the bearing surface.

3. Scaffold according to claim 1, wherein the construction member is part of an additional cross element which is part of the construction assembly.

4. Scaffold according to claim 1, wherein the construction member is part of an upright which is part of the construction assembly.

5. Scaffold according to claim 1, wherein the construction member is part of an additional frame which is part of the construction assembly.

6. Scaffold according to claim 4, wherein the frame besides said foot comprises an additional foot and the construction assembly besides said construction member comprises an additional construction member in which the feet are at each corner on the lower side of the frame.

7. Scaffold according to claim 1, wherein the frame and the construction assembly have coupling parts which are coupled together.

8. Scaffold according to claim 7, wherein the coupling parts on the frame and/or the construction member are provided with surfaces that incline upwards.

9. Scaffold according to claim 7, wherein there are stops on the construction assembly and/or the frame with which the coupling parts are positioned with respect to each other during assembly.

10. Method for assembling a scaffold comprising the coupling of a frame defining a first plane to a construction assembly having at least two tubular uprights, arranged in parallel and defining a substantially vertical second plane, the improvements wherein a foot forming part of said frame is placed on a construction member of said construction assembly, with said first plane arranged horizontally or at an angle to said second plane, allowing the weight of said frame to be supported on said scaffold, so that said frame is tilted into a vertical position whereby said frame, by means of a supporting surface of said foot, rests on said construction member, is pivoted on said construction member about an axis lying in said second plane, and is thereafter coupled to said uprights such that said first plane substantially coincides with said second plane, and wherein said foot is provided with a stepped opening comprising a first part having a first step with respect to the open side of the opening and a first depth with respect to the open side of the opening, which is limited by a wall that forms the supporting surface and a second part which is at a greater depth from the open side of the opening than the depth of the first part in which the construction member is situated when assembled, wherein the first part having a width greater than the width of the second part.

11. Method according to claim 10, wherein after the frame has been tilted up into the vertical position, the foot is moved horizontally where the supporting surface is freed from the construction member as a result of which the frame moves downwards with respect to the construction member and coupling is effected.

12. Method according to claim 10, wherein after the frame has been tilted into the vertical position, the frame is first lifted up and then brought down again in order to bring about coupling.

13. Method according to claim 11, wherein at the end of the tilting movement, coupling parts on the frame and on the construction assembly are positioned with respect to each other and that when the frame is moved downwards the coupling parts couple together.

14. Method according to claim 13, wherein positioning takes place because the frame strikes a stop on the construction assembly at the end of the titling movement.

* * * * *